US005915606A

United States Patent [19]

Jensen

[11] Patent Number: 5,915,606

[45] Date of Patent: Jun. 29, 1999

[54] CONTAINER CARRIER

[76] Inventor: Niels C. Jensen, 855 Jerseyville Road West, Jerseyville, Ontario, Canada, L0R 1R0

[21] Appl. No.: 08/986,828

[22] Filed: Dec. 8, 1997

[51] Int. Cl.[6] ..... A45F 3/04; A45F 5/00

[52] U.S. Cl. ..... 224/148.6; 224/647; 224/605; 224/623; 224/625; 224/259

[58] Field of Search ..... 224/148.1, 148.4, 224/148.5, 148.6, 191, 600, 603, 604, 605, 623, 625, 627, 637, 645, 646, 647, 649, 650, 651, 259, 260, 262

[56] References Cited

U.S. PATENT DOCUMENTS

| | | | |
|---|---|---|---|
| 119,400 | 9/1871 | Penrose . | |
| 860,395 | 7/1907 | Lindsey | 224/649 |
| 1,145,176 | 7/1915 | Willson . | |
| 1,290,827 | 1/1919 | Yergason | 224/623 |
| 1,383,315 | 7/1921 | Lethern | 224/148.6 |
| 2,441,115 | 5/1948 | Lambert . | |
| 2,477,432 | 7/1949 | Walsh | 224/260 |
| 2,643,803 | 6/1953 | Bates . | |
| 2,717,109 | 9/1955 | Walsh . | |
| 2,945,614 | 7/1960 | Wittmann, Sr. . | |
| 2,987,231 | 6/1961 | Lewis . | |
| 2,995,281 | 8/1961 | Dixon . | |
| 3,051,428 | 8/1962 | Schult . | |
| 3,285,485 | 11/1966 | Slator . | |
| 3,876,125 | 4/1975 | Emmert . | |
| 3,997,092 | 12/1976 | Pogwizd . | |
| 4,172,542 | 10/1979 | Lankford . | |
| 4,325,503 | 4/1982 | Swinney . | |
| 4,919,317 | 4/1990 | Luedtke . | |
| 4,923,105 | 5/1990 | Snyder . | |
| 4,972,982 | 11/1990 | Harbour . | |
| 5,016,791 | 5/1991 | Burow . | |
| 5,016,797 | 5/1991 | Rowledge . | |
| 5,163,591 | 11/1992 | Leiserson et al. . | |
| 5,261,584 | 11/1993 | Albert . | |
| 5,340,006 | 8/1994 | Li . | |
| 5,364,156 | 11/1994 | Zerow . | |
| 5,385,281 | 1/1995 | Byrd . | |
| 5,489,051 | 2/1996 | Robinson . | |
| 5,490,618 | 2/1996 | Davidson . | |
| 5,497,921 | 3/1996 | Dancyger et al. . | |
| 5,505,353 | 4/1996 | Marsh, Jr. | 224/148.6 |

*Primary Examiner*—Allan N. Shoap
*Assistant Examiner*—Gregory M. Vidovich

[57] ABSTRACT

The invention provides a simple, inexpensive and comfortable container carrier for securing a container for fluids, such as paint, stain, nuts, bolts or the like, to a person's body thereby freeing up a person's hands for other tasks, such as climbing a ladder, with an associated increase in safety, mobility and productivity. The carrier permits easy access by the person to the container contents, whether the person is right or left-handed, and includes a body harness and a support for the container coupled to the body harness.

9 Claims, 2 Drawing Sheets

FIG. 2
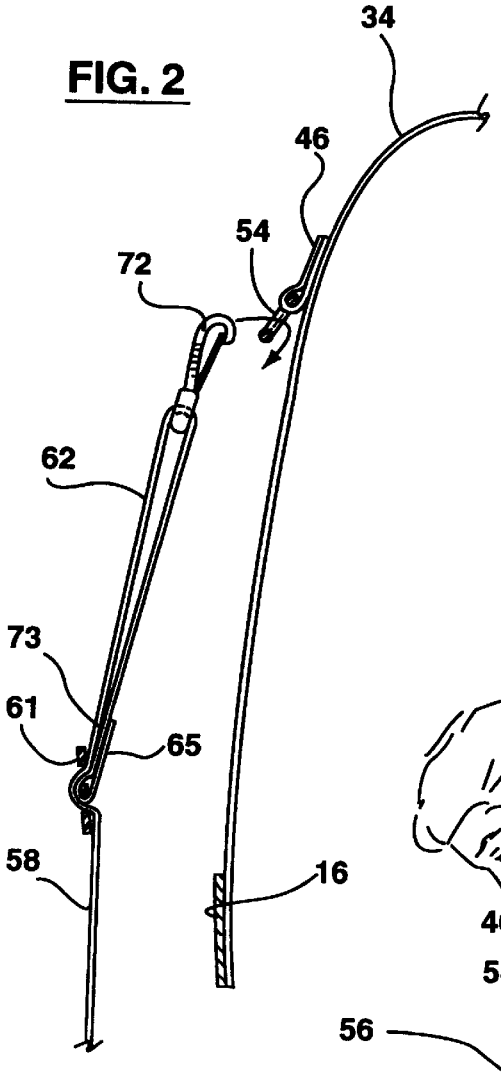
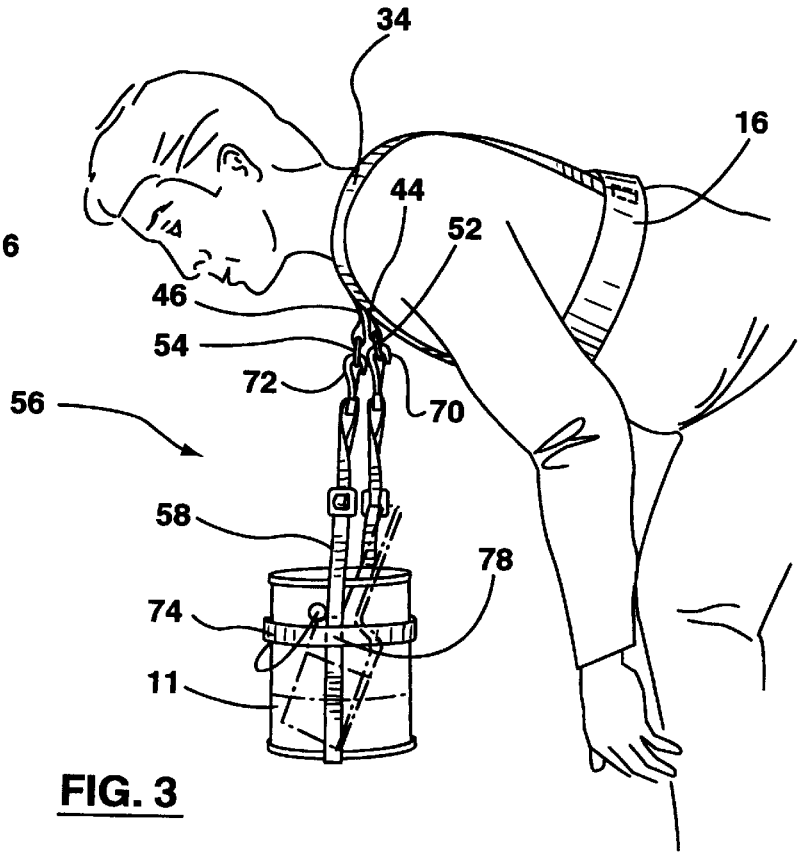
FIG. 3

CONTAINER CARRIER

FIELD OF THE INVENTION

This invention relates to body harnesses for carrying containers for fluids, such as paint, stain, nuts, bolts, or the like, with minimized risk of spillage and in such manner as to free up a person's hands for other activities.

BACKGROUND OF THE INVENTION

A significant problem facing many painters is what to do with a container of paint or stain while travelling to the work area and during painting. If one leaves the container at a fixed location, such as a window ledge, on the ground, or on the step of a stairwell, one has to return to that spot each time to rewet the brush. This may render the painting process tiresome and time-consuming, especially where one has to bend or stoop to reach the container.

An alternative to leaving the container in a fixed spot is to carry the container with one hand while holding a brush with the other hand. However, the hand holding the container may become tired and sore as a result of having to support the container. Also, the container may tip over and spill its contents if bumped against an object or if not held in a level position. Furthermore, the hand holding the container is unavailable for other tasks and some actions, such as the action of climbing a ladder, are made more challenging if not dangerous.

The above difficulties have been addressed by numerous holders of paint containers or the like in the past. However, there is still a need for a spill-resistant container carrier which is of a simple, inexpensive, comfortable and light-weight construction, allowing for even load distribution, for use by both right and left-handed people, and which allows for increased mobility, safety and productivity of the user.

SUMMARY OF THE INVENTION

The invention provides a carrier for carrying an open-topped container of spillable fluid and securing the container to a person's body, the carrier including a body harness and a container support coupled to the body harness.

The body harness includes an adjustable belt, to be worn around a person's torso, the belt having first and second ends coupled to complementary first and second releasable engagement members, respectively. Also included in the body harness are two similar shoulder straps each having a forward and a rearward end. The forward ends are attached to a forward portion of the belt in a spaced apart relationship. The straps are adapted to extend from the forward ends generally vertically upwardly across the chest of a person, over the shoulders, and to overlap in a criss-cross relationship at a rearward portion of the person. The rearward ends are attached to a rearward portion of the belt in spaced apart relationship. Each of the straps has a retainer mounted on a forward portion thereof above the belt.

The container support includes a first adjustable holding strap having attachment members at each end thereof, for releasable engagement with respective retainers of the shoulder straps. A second holding strap is attached to the first holding strap. The second holding strap is formed into a loop which is generally horizontal when the carrier is in use. The loop is of a predetermined diameter to fit snugly around containers of select sizes. Diametrically opposed ends of the loop are sewn perpendicularly to corresponding portions of the first holding strap adjacent a lower U-shaped portion thereof to form a container holder.

BRIEF DESCRIPTION OF THE DRAWINGS

A preferred embodiment of the invention will now be described with reference to the drawings. Note that locational and directional indicators used throughout the specification are with reference to the embodiment when being worn by a person.

FIG. 2 is a side view of an upper, forward portion of the carrier in partial cross-section;

FIG. 3 is a side view of the carrier in use by a person in a bent forward position.

DETAILED DESCRIPTION OF THE PREFERRED EMBODIMENT

Figure 1:
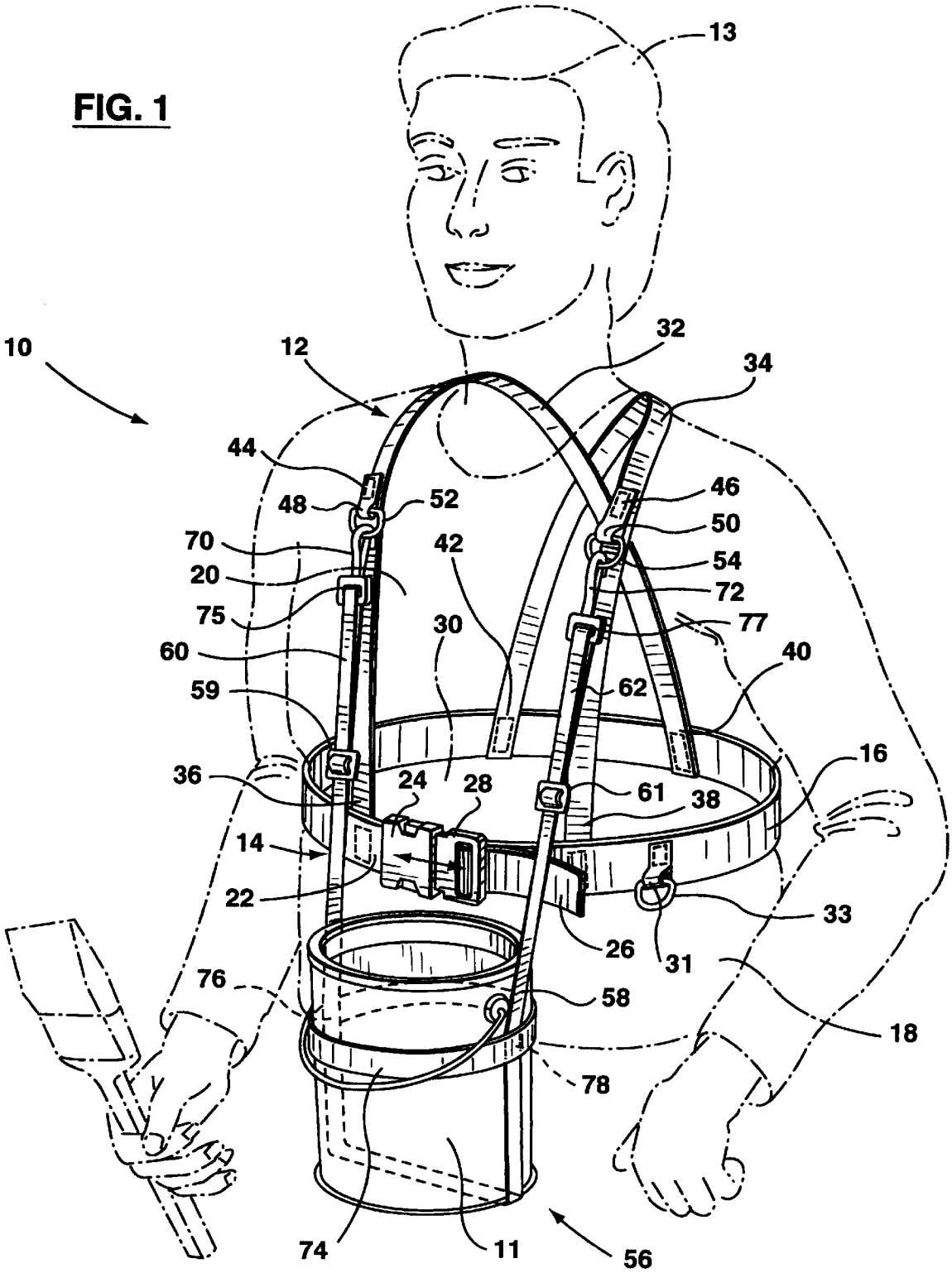
FIG. 1 is a perspective view of a container carrier according to the invention being worn by a person who is shown in ghost outline.

Referring mainly to FIG. 1 but with reference also to FIG. 2, the invention provides a container carrier generally indicated by numeral 10 for securing containers such as a paint can 11 to a user's body. The carrier includes a body harness 12 and a container support, indicated generally by numeral 14, releasably attached thereto in a manner as will be further described.

The body harness 12 is to be worn by a person in a manner which will become apparent by the following description. The body harness includes an adjustable belt 16 to be worn around the person's torso, intermediate of the waist 18 and chest 20 area. The belt 16 is made of polypropylene webbing and has a first end 22 attached to a female buckle member 24 and a second end 26 in slidable engagement with a male buckle member 28 complementary to the female buckle member 24. When properly worn, the buckle members 24, 28 are in releasable engagement at a central front portion 30 of the person 13. Adjustment of the belt at the male buckle member end adapts the belt to fit snugly around the body of the person 13. Sewn to a forward portion of the belt in a spaced apart relationship are two retainers, each retaining a D-ring, for releasable attachment of desirable accoutrements such as a tool apron, or the like. Only retainer 31 and D-ring 33 being shown for the sake of simplicity.

Two identical shoulder straps 32, 34, made of the same material as the belt, have forward ends 36, 38 sewn to forward portions of the belt, in a spaced apart relationship, on either side of the buckle members. The straps extend from their forward ends generally vertically upwardly across the chest of the person, over the shoulders, overlap in a criss-cross relationship to the rear of the person, and have their other ends, being rearward ends 40, 42, sewn to rearward portions of the belt in a spaced apart relationship. The shoulder straps 32, 34 are of a pre-determined length such that the belt is located within an area intermediate the waist 18 and chest 20 of the person, the length being selected by the person to achieve optimized weight distribution, support and comfort.

Each strap is provided with a ring retainer 44, 46 also made of polypropylene webbing, sewn to an upper forward portion thereof. The retainers have portions thereof formed into loops 48, 50 for retaining D-rings 52, 54. The D-rings are pivotable about horizontal axes parallel to the axes of the loops 48, 50.

The container support 14 includes a first adjustable holding strap 58 made of polypropylene webbing. The ends of the strap 58 have been formed into loops 60, 62 which engage hook members 70, 72. The hook members are adapted to releasably engage respective D-rings 52, 54 on the harness (FIGS. 1 and 2). The loops 60, 62 are formed by threading ends of the strap 58 through apertures 75, 77 of hook members 70, 72 and then through buckles 59, 61 where the ends of the strap 58 are sewn to adjacent end portions of the strap 58 (only end 65 and end portion 73) being shown in FIG. 2 thereby securing the ends and end portions of the strap 58 to the buckles 59, 61. In such manner, the first holding strap 58 of the container support 14 is releasably engagable with the harness and has a length which is adjustable through adjustment of the loops 60, 62 via buckles 59, 61.

The first holding strap 58 extends downwardly by gravity from the hook members 70, 72 to form a U-shape, when the strap 58 is engaged with the harness. Adjacent the bottom of the "U" is a second holding strap 74, again made of polypropylene webbing, sewn into a loop and having diametrically-opposed portions sewn perpendicularly to corresponding portions 76, 78 of the first holding strap, the corresponding portions being equidistant from the bottom of the "U" such that the second holding strap lies in a generally horizontal plane, when the carrier 10 is in use. The second holding strap 74, in this embodiment, is dimensioned to fit snugly around the diameter of a standard 3.78 liter paint container having an outside diameter of 6⁹⁄₁₆". The first and second holding straps 58, 74 therefore form a holding structure for supporting the paint container 11, with the first holding strap 58 supporting the bottom of the container and the second holding strap 74 supporting the sides of the container and locating the first holding strap centrally of the container.

FIG. 3 illustrates the person of FIG. 1 in a bent forward position. Because the hook members 70, 72 are pivotable about horizontal axes of the D-rings 52, 54 and slidable laterally along the D-rings, the container 11 will remain substantially level throughout bending actions of the person. For example, the person may bend forward or to either side with minimum risk of spillage.

The afore-described embodiment of the invention is most suitable for carrying loads equivalent to a ¼ to ½ full container of paint. It is less likely that this amount of fluid will be spilled when the person bends or stoops and the load may be more comfortably distributed about the back, chest, ribcage and shoulder areas of the person. Some discomfort resulting from the load may be eliminated by adjusting the first holding strap 58 of support 14 thereby altering the position of the paint container relative to the centre of gravity of the person.

The central location of the container allows for easy access thereto by either hand of the person.

It will be appreciated that the carrier may consist of any materials or combination of materials known in the art as are suitable for providing a harness that is both comfortable to wear and a container carrier that gives sturdy support for loads similar to a ¼ to ½ full can of paint.

While the ends 36, 38, 40, 42 of the shoulder straps are shown to be sewn to the inside of the belt, it will be appreciated that optimum comfort may be achieved with the ends of the straps being sewn to the outside of the belt. Further, the shoulder straps 32, 34 are to be manufactured to different pre-determined lengths to ensure proper location of the belt intermediate the waist and chest of people of different sizes and in accordance with individual preference. For added support, the straps may be sewn together where they criss-cross in the back, or, they may be threaded through a slidable buckle member allowing for adjustment of the location of where the straps cross.

The belt 16 may be a sectional belt (not shown) including at least two belt sections connected by one or more connecting rings to which a tool apron or other desirable accoutrement may be secured.

The rings 52, 54 on the forward portion of the shoulder straps 32, 34 may be circular, square, or any other shape that would permit rotation of the hook members 70, 72 about horizontal axes and sliding of the hook members laterally along the rings in a manner such that a supported paint container may remain substantially level through bending and stooping motions of a person. The rings may also be located lower on the shoulder straps than shown in the drawings. Indeed, they may be mounted to selected positions along the forward portion of the shoulder strap, intermediate the belt and shoulder level of a person to meet individual demand.

The carrier of the preferred embodiment is suitable for carrying containers having circumferences similar to that of a standard paint container which may, for instance, be used to contain stain, nails, screws, bolts, or the like. However, it will be appreciated that the second holding strap 74 may be dimensioned to fit containers having diameters different from the diameter of a standard paint container.

The foregoing description is for illustration only and is not meant to limit the scope of the invention as defined by the following claims.

I claim:

1. A carrier for carrying an open-topped container of spillable fluid and for securing the container to a person's body, the carrier including a body harness having a belt to be worn around the person's torso, the belt having first and second ends coupled to complementary first and second releasable engagement members, respectively;

two similar shoulder straps each having a forward and a rearward end, said forward ends being attached to a forward portion of the belt in a spaced apart relationship, the straps being adapted to extend from said forward ends generally vertically upwardly across the chest of the person, over the shoulders, and to overlap in a criss-cross relationship at a rearward portion of the person, the rearward ends being attached to a rearward portion of the belt in a spaced apart relationship;

a first retainer mounted on a forward portion of one of said shoulder straps above said belt;

a second retainer mounted on a forward portion of the other of said shoulder straps above said belt;

and a container support adapted to be coupled to the body harness having a first adjustable holding strap having attachment means at each end thereof for releasably engaging respective said retainers; and a second holding strap adapted to form a generally horizontal loop when the carrier is in use, said loop being of a predetermined diameter to fit snugly around the open-topped container, and having diametrically opposed ends fixed perpendicularly to corresponding portions of the first holding strap adjacent a lower U-shaped portion thereof to form a container holder;

such that when the person wears the carrier supporting the container, the person will have at least one hand freed for performing other tasks, have ready access to the fluid in the container, and be able to enjoy increased mobility with a minimized risk of spilling the fluid in the container.

2. A carrier according to claim 1 wherein said belt is adjustable.

3. A carrier according to claim 2 wherein said shoulder straps are of a predetermined length selected to locate the belt at a selected position within an area between the chest and waist of the person for optimized support and comfort.

4. A carrier according to claim 3 wherein said retainers are mounted on an upper portion of said forward portion of the shoulder straps.

5. A carrier according to claim 4 wherein the second holding strap is dimensioned to fit around the circumference of a standard paint container.

6. A carrier according to claim 1 wherein said shoulder straps are of a predetermined length selected to locate the belt at a selected position within an area between the chest and waist of the person for optimized support and comfort.

7. A carrier according to claim 1 wherein said retainers are mounted on an upper portion of said forward portion of the shoulder straps.

8. A carrier according to claim 1 wherein the second holding strap is dimensioned to fit around the circumference of a standard paint can.

9. A carrier for carrying an open-topped container of spillable fluid and for securing the container to a person's body, the carrier including a body harness having an adjustable belt to be worn around the person's torso, the belt having first and second ends coupled to complementary first and second releasable engagement members, respectively;

two similar shoulder straps each having a forward and a rearward end, said forward ends being attached to a forward portion of the belt in a spaced apart relationship, the straps being adapted to extend from said forward ends generally vertically upwardly across the chest of the person, over the shoulders, and to overlap in a criss-cross relationship at a rearward portion of the person, the rearward ends being attached to a rearward portion of the belt in a spaced apart relationship, each of said straps being of such length as to locate the belt at selected positions within an area between the chest and waist of the person for optimized support and comfort;

a first retainer mounted on a forward portion of one of said shoulder straps above said belt;

a second retainer mounted on a forward portion of the other of said shoulder straps above said belt; and a container support having a first adjustable holding strap having attachment means at each end thereof, for releasably engaging respective said retainers; and a second holding strap adapted to form a generally horizontal loop when the carrier is in use, said loop being of a predetermined diameter to fit snugly around the open-topped container, and having diametrically opposed ends fixed perpendicularly to corresponding portions of the first holding strap adjacent a lower U-shaped portion thereof to form a container holder;

such that when the person wears the carrier supporting the container, the person will have at least one hand freed for performing other tasks, have ready access to the fluid in the container, and be able to enjoy increased mobility with a minimized risk of spilling the fluid in the container.

* * * * *